US005521356A

United States Patent [19]

Bauer

[11] Patent Number: 5,521,356

[45] Date of Patent: May 28, 1996

[54] GLOW PLUG WITH CONSTRUCTION FOR MINIMIZING HEAT TRANSFER BETWEEN INTERIOR POLE AND PTC REGULATING ELEMENT

[75] Inventor: Paul Bauer, Steinheim, Germany

[73] Assignee: Beru Ruprecht GmbH & Co. KG, Germany

[21] Appl. No.: 70,380

[22] PCT Filed: Oct. 8, 1992

[86] PCT No.: PCT/EP92/02318

§ 371 Date: Jun. 8, 1993

§ 102(e) Date: Jun. 8, 1993

[87] PCT Pub. No.: WO93/07423

PCT Pub. Date: Apr. 15, 1993

[30] Foreign Application Priority Data

Oct. 8, 1991 [DE] Germany ..... 41 33 338.1

[51] Int. Cl.[6] ..... F23Q 7/00

[52] U.S. Cl. ..... 219/270; 123/145 A; 219/267; 361/266

[58] Field of Search ..... 219/270, 552, 219/553, 505; 123/145 A, 145 R; 361/264, 265, 266; 338/22 R

[56] References Cited

U.S. PATENT DOCUMENTS

| | | | |
|---|---|---|---|
| 4,556,781 | 12/1985 | Bauer . | |
| 4,582,980 | 4/1986 | Izzi | 219/270 |
| 4,733,053 | 3/1988 | Mueller . | |
| 4,963,717 | 10/1990 | Woelfle | 219/270 |
| 5,039,839 | 8/1991 | Masaka et al. | 219/270 |
| 5,059,768 | 10/1991 | Hatanaka et al. | 219/270 |
| 5,091,631 | 2/1992 | Dupuis et al. . | |
| 5,132,516 | 7/1992 | Hatanaka et al. | 219/270 |
| 5,172,664 | 12/1992 | Mueller et al. . | |
| 5,218,183 | 6/1993 | Kimata | 219/270 |

FOREIGN PATENT DOCUMENTS

| | | | |
|---|---|---|---|
| 0336625 | 10/1989 | European Pat. Off. . | |
| 3911831 | 10/1990 | Germany . | |
| 9112507 | 5/1992 | Germany . | |
| 62-17520 | 1/1987 | Japan | 219/270 |

*Primary Examiner*—John A. Jeffery
*Attorney, Agent, or Firm*—Sixbey, Friedman, Leedom & Ferguson; David S. Safran

[57] ABSTRACT

A glow plug having an interior pole and a glow tube with a tip portion, a heating element located in the tip portion, and a regulating element, formed of an electrically conductive material having positive temperature-resistance coefficients, arranged in the glow tube. The interior pole of the glow plug is serially connected with the regulating element, the regulating element is serially connected to the heating element, and the heating element is serially connected with the glow tube tip in a construction for minimizing heat transfer between the regulating element and the interior pole.

17 Claims, 1 Drawing Sheet

GLOW PLUG WITH CONSTRUCTION FOR MINIMIZING HEAT TRANSFER BETWEEN INTERIOR POLE AND PTC REGULATING ELEMENT

BACKGROUND OF THE INVENTION

1. Field of the Invention

The present invention relates to a glow plug, having a glow tube containing a heating element, in its tip portion, and also, a serially connected regulating element. More specifically, the invention relates to such a glow plug wherein the regulating element is formed of an electrically conductive material with a positive temperature-resistance coefficients, and wherein an interior pole of the glow plug is serially connected with the regulating element, the regulating element is serially connected to the heating element, and the heating element is serially connected with the glow tube tip.

A glow plug of this kind, for instance, is described in U.S. Pat. No. 4,556,781, where a glow plug has a glow tube whose tip portion contains a heating filament, and in the connection region, contains a regulating filament disposed in an insulating material.

2. Description of Related Art

Other applications have been subsequently filed with the objective to achieve a corresponding thermal decoupling between the regulating and heating filaments, whereby the function of the above glow plug was alleged to be further improved. Examples of other glow plugs of the assignee of the present application which have series connected heating and regulating elements can be found in U.S. Pat. Nos. 4,733,053; 5,091,631; and 5,172,664.

Glow plugs of this kind, known from the state of the art, have the disadvantage that they exhibit too low a stability to meet the established demands for such glow plug reliability, and that during a continuous glow action, i.e. extended glow time, with the engine in operation, they cause environmentally detrimental exhaust gases.

SUMMARY OF THE INVENTION

Accordingly, it is the objective of the present invention, while avoiding the drawbacks of the present state of the art, to provide a glow plug which has a high degree of stability even with a longer period of afterglow, while simultaneously ensuring that the pre-glow time previously obtained will be maintained; further, to facilitate mass production in the usual and cost-effective manner. These objectives can be attained with a glow plug in which the heat transfer between regulating element and the interior pole is minimized, for example, by making the interior pole of a material which is electrically conductive and is thermally poorly conductive.

Intensive tests have shown that changes in the system heating filament/regulating filament, and particularly, the suggested thermal decoupling of the heating and regulating filament, did not yield the desired results. Rather, it was found that a possible reason for the lower stability of the conventional glow plugs is that the temperature distribution across the regulating resistor is uneven, so that there is formation of localized areas of overheating, at which points there are concentrations of additional fuel conversion, resulting in a further rise in temperature, causing increased wear and burn-out of the regulating resistor. An explanation for the above is seen in the fact that there is a cooling effect by the interior pole, in the region of the connection of the regulating filament to the interior pole of the glow plug. This not only results in an uneven temperature distribution across the regulating filament, but also means that the cooler region remains low-ohmic and contributes less to the control function of the glow plug current output than theoretically would be the case in an "unimpeded" heat-up of this regulating filament region.

The solution to overcoming such problems is seen in designing the system interior pole/transition interior—pole-regulating filament/regulating filament in a manner such that the detrimental cooling effect of the interior pole is minimized while simultaneously meeting the other requirements for a glow plug, and whereby further consideration is given to the conventional geometry of the glow tubes regarding glow tube length, length and geometry of the heating and regulating filaments, etc., to be accommodated in the housing.

The invention is further described by way of the figures of the drawing.

DETAILED DESCRIPTION OF THE PREFERRED EMBODIMENTS

Figure 1:
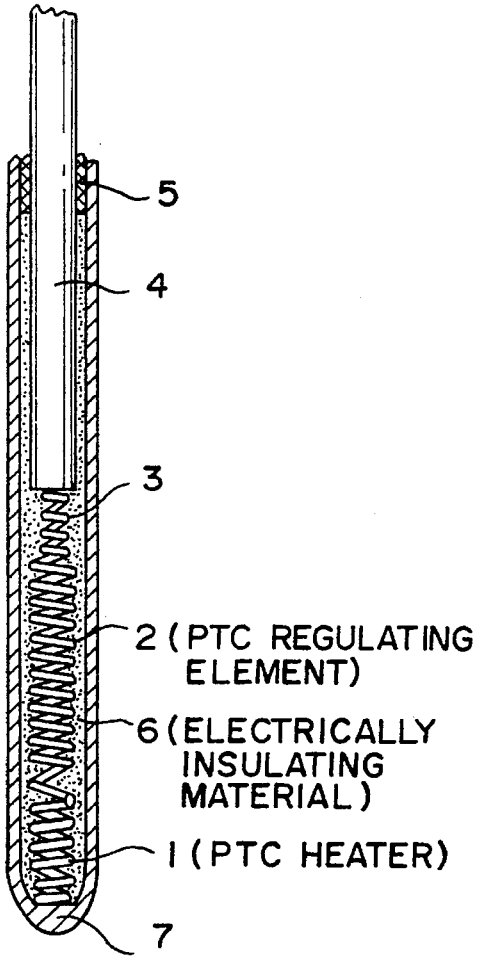
FIG. 1 is a cross-sectional view through a heating rod of the glow plug, in accordance with the invention.

The heating rod according to FIG. 1 consists of a tube 7, containing heating filament 1, regulating filament 2, interior pole 4 and a sealing ring (O-ring) 5 disposed in an electrically insulating material 6 (e.g. manganese oxide). The decoupling, in accordance with the inventive process, between the actual regulating filament region 2 (with windings of larger diameter) and the interior pole 4 is effected via filament region 3, (having smaller winding diameters).

Preferably, the diameter of the region 3 windings are smaller than the half-diameter of the actual regulating region 2 of the regulating filament.

The wire length of area 3 corresponds to approximately 1/10th to approximately 1/20th of the entire wire length of the variable resistor at room temperature. Preferably, the length of this element is greater then 2.5 mm to 4 mm, with a strong preference for having a minimum of four windings.

The winding diameter in region 3, should, as a lower limit, approximately, correspond to a fourfold thickness of that of the regulating wire.

The gradient of this region 3 is equal to or greater than the double wire thickness.

The drawing shows the regulating filament region 2 (having a larger diameter) as one piece. In fact, however, it may have a two-part or multiple part configuration, whereby the subranges, respectively, may consist of different alloys with differing temperature resistance coefficients.

The inventive concept finds particular application in cases where regulating filaments with high temperature resistance coefficients are used, for example, where the resistance ratio of the resistance related to a temperature range of 20° C./1000° C. is greater than about 7.5 (with>12 becoming extremely critical). This especially applies to regulating filaments consisting of materials which do not have a linear rise in resistance but have an uneven rise, as described, for example, in applications U.S. Pat. No. 5,091,631 and DE-OS 39 23 582. Under such circumstances the glow plugs, in accordance with the present invention, are particularly suitable for applications of continuous glow or extended glow, while the engine is in operation.

The embodiment according to FIG. 1 shows a conventional interior pole 4, which, preferably, is comprised of a material with properties of good electric conductivity and poor thermal conductivity. An example for such material would be a steel with a substantial Cr-Ni content, which material is easily accessible to the practitioner in the alloy field. As, additionally, such material is corrosion resistant by virtue of its composition, corrosion protection, as is often required, can be dispensed with for the cable connection (M5-M4 threads). Accordingly, it is a special embodiment of the invention, not depicted, that the interior pole consists of a material which is electrically conductive, but which has poor thermal conductivity. In this particular variation, transition region 3 can be eliminated (or, respectively, in combination with transition region 3, heat dissipation can be further reduced).

Figure 2:
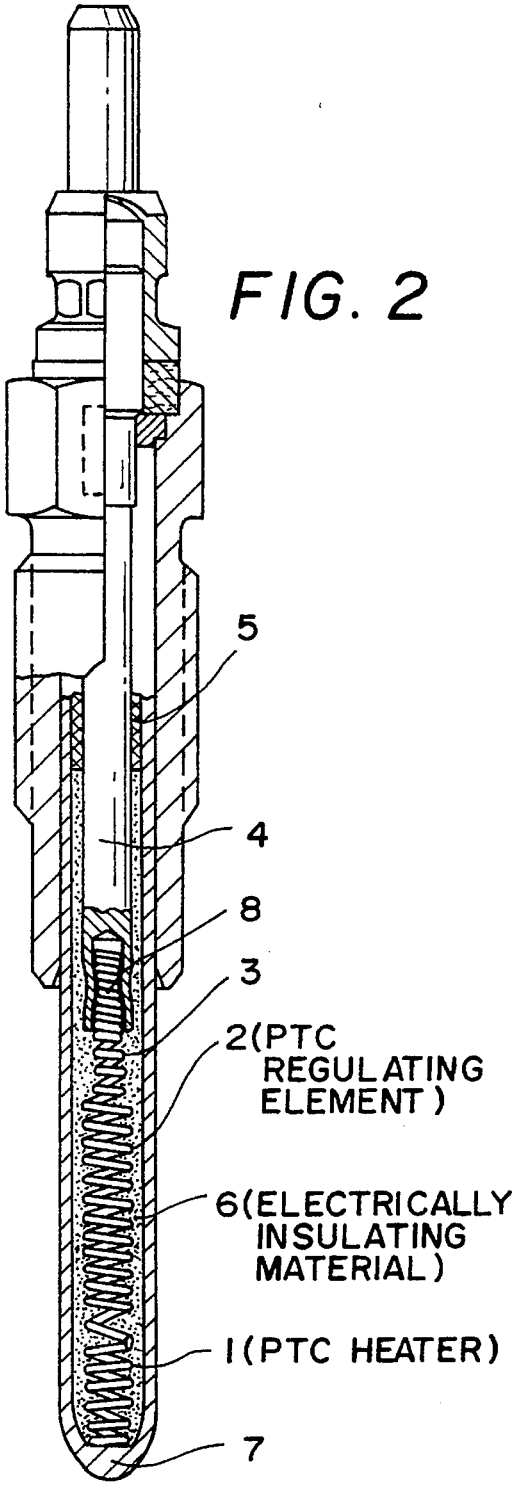
FIG. 2 is a schematic cross-sectional view, showing a variation of the glow plug, in accordance with the invention.

FIG. 2 shows a glow plug configuration, in accordance with the present invention, in which the glow element, according to FIG. 1, is integrated, whereby the transition region 3 and interior pole 4 are connected by a conventional plug with "socket coupling" 8, with additional caulking.

This variation of the invention makes it clear that the regulating filament 2 is capable of heating up over the entire length to practically an identical temperature, and that neither the axially flowing return heat from the region of heating filament 7, nor the heat extending radially from the regulating filament to the glow plug, is withdrawn unevenly, and, further, that heat dissipation to the interior pole is sufficiently impeded.

The transition region 3 is of one-piece design in the standard version of the invention and consists of the same material as the adjacent regulating filament 2. In accordance with the general inventive concept, however, this region 3 can also consist of a material which is different from that of the region adjacent to regulating filament 2. In such instance, the material of this region 3 should have properties of electric conductivity, but simultaneously display low thermal conductivity.

Such materials and alloys are known per se and may, for instance, also include materials which were described previously with reference to the interior pole, when it has low thermal conductivity.

In one variation of the invention, the glow tube diameter is about 6 mm, the diameter of the regulating filament 2 is about 3.8 mm, and the diameter of the transition region 3 is about 1.8 mm, with a regulating wire thickness of about 0.35 min. The total length of the regulating wire amounts to 200 mm to 220 mm, whereby the length of the regulating wire in region 3 is about 12 mm.

Application of the inventive concept provides the benefit that the maximum temperature of the glow plug rod, or that of the heating filament itself, at which the control function commences, is lowered, so that on one hand the pre-glow time is practically undiminished, while on the other hand, the life of the glow plug, under after-glow conditions, is markedly increased.

I claim:

1. Glow plug having an interior polo and a glow tube with a tip portion, a heating element located in said tip portion, and a regulating element arranged in the glow tube serially connected to the heating element; wherein the regulating element is formed of an electrically conductive material having positive temperature coefficient wherein the interior pole of the glow plug is serially connected with the regulating element, the regulating element is serially connected to the heating element, and the heating element is serially connected with the glow tube tip, and wherein a means for minimizing heat transfer from the regulating element to the interior pole is provided; and wherein the means for minimizing heat transfer from the regulating element to the interior pole comprises the interior pole being formed of a material which in electrically conductive and has a low thermal conductivity.

2. Glow plug according to claim 1, wherein said means for minimizing heat transfer further comprises a wire element formed of an electrically conductive and low thermal conductivity material being arranged between the interior pole and the regulating element.

3. Glow plug according to claim 1, wherein the regulating filament is formed of a one-piece construction.

4. Glow plug according to claim 1, wherein the regulating filament is formed of at least two parts, individual parts of which are formed of different alloys with different temperature-resistance coefficients.

5. Glow plug according to claim 4, wherein at least one of the parts of the regulating filament is formed of a material having a resistance ratio which is greater than approximately 7.5, relative to a temperature range of 20° C. to 1000° C.

6. Glow plug according to claim 5, wherein the material of which said at least one part of the regulating filament is formed experiences a steep nonlinear rise in resistance when said heating element is heated to incandescent.

7. Glow plug having an interior pole and a glow tube with a tip portion, a heating element located in said tip portion, and a regulating element arranged in the glow tube serially connected to the heating element; wherein the regulating element is formed of an electrically conductive material having positive temperature coefficient wherein the interior pole of the glow plug is serially connected with the regulating element, the regulating element is serially connected to the heating element, and the heating element is serially connected with the glow tube tip, wherein a means for minimizing heat transfer from the regulating element to the interior pole is provided; and wherein the means for minimizing heat transfer comprises the regulating element being formed of a wound regulating filament having two wound regions, a first filament region which has a smaller winding diameter than that of a second region formed by a main portion of the regulating filament.

8. Glow plug according to claim 7, wherein the filament region has a filament length that is about 1/10 to about 1/20 of the entire length of the regulating filament at room temperature.

9. Glow plug according to claim 8, wherein said filament region is longer than 2.5 mm to 4 mm.

10. Glow plug according to claim 9, wherein said regulating filament has at least four windings in said filament region.

11. Glow plug according to claim 10, wherein said windings have a diameter that is smaller than half that of windings of the regulating filament in said main portion of the regulating filament.

12. Glow plug according to claim 11, wherein the diameter of the windings in said filament region is at least as great as approximately a four-fold thickness of the regulating filament.

13. Glow plug according to claim 7, wherein the main portion of the regulating filament and said filament region thereof are formed of a one-piece configuration.

14. Glow plug according to claim 7, wherein the regulating filament is formed of at least two parts, individual parts of which are formed of different alloys with different temperature-resistant coefficients.

15. Glow plug according to claim 14, wherein at least one of the parts of the regulating filament is formed of a material having a resistance ratio which is greater than approximately 7.5, relative to a temperature range of 20° C. to 1000° C.

16. Glow plug according to claim 15, wherein the material of which said at least one part of the regulating filament is formed experiences a steep nonlinear rise in resistance when said heating element is heated to incandescent.

17. Glow plug according to claim 14, wherein at least part of the regulating filament is formed of a material having a resistance ratio of 12, relative to a temperature range of 20° C. to 1000° C.

* * * * *